United States Patent [19]

Yoneda et al.

[11] Patent Number: 4,540,126

[45] Date of Patent: Sep. 10, 1985

[54] FUEL INJECTION NOZZLE

[75] Inventors: Kenji Yoneda, Atsugi; Kunihiko Sugihara, Tokyo, both of Japan

[73] Assignee: Nissan Motor Co., Ltd., Japan

[21] Appl. No.: 519,265

[22] Filed: Aug. 1, 1983

[30] Foreign Application Priority Data

Apr. 8, 1982 [JP] Japan ..... 57-118592[U]
Dec. 7, 1983 [JP] Japan ..... 58-107952[U]

[51] Int. Cl.[3] ..... F02M 61/06
[52] U.S. Cl. ..... 239/533.4
[58] Field of Search ..... 239/533, 533.2–533.11

[56] References Cited

U.S. PATENT DOCUMENTS 3,368,761 2/1968 Pelizzoni ..... 239/533.4
3,838,821 10/1974 Berlyn ..... 239/533.7
4,208,014 6/1980 Müller ..... 239/533.4

FOREIGN PATENT DOCUMENTS 593244 5/1959 Italy ..... 239/533.3

*Primary Examiner*—Andres Kashnikow
*Assistant Examiner*—Scott D. Malpede
*Attorney, Agent, or Firm*—Leydig, Voit & Mayer

[57] ABSTRACT

A fuel injection nozzle is provided with such an annular fuel passage that its fuel passage section is, at the earlier stage of fuel injection, maintained smaller than the whole sum of the sectional areas of injection orifices and adapted to increase gradually in response to the lift of a nozzle needle so that the rate of fuel injection increases gradually.

10 Claims, 9 Drawing Figures

FUEL INJECTION NOZZLE

BACKGROUND OF THE INVENTION

1. Field of the Invention

The present invention relates in general to fuel injection nozzles and particularly to improvements in a so-called hole type fuel injection nozzle for use in direct fuel-injection diesel engines.

2. Description of the Prior Art

It has been proposed to construct a hole-type fuel injection nozzle in such a manner as disclosed in the provisional Japanese Utility Model Publication No. 54-112918. This prior art fuel injection nozzle however encounters the problem that it leads to a large nitrogen oxides (NOx) content in the exhaust gases and to a large combustion noise.

SUMMARY OF THE INVENTION

It is an object of the present invention to provide a fuel injection nozzle which completely solves the above noted problems.

A feature of the present invention is the provision of a fuel injection nozzle which comprises a hollow nozzle body formed at the tip portion thereof with a conical valve seat and at least one fuel injection orifice having an upstream end located in the valve seat; a nozzle needle axially movable in the nozzle body and formed at an end with a conical seating surface engageable with the valve seat to control fuel flow through the injection orifice; and means for defining between the nozzle body and the nozzle needle at a location upstream of a fuel passage which is to be formed between the valve seat and the seating surface upon lifting of the nozzle needle, an annular fuel passage having a fuel passage section of which sectional area is, at the earlier stage of fuel injection, maintained smaller than the sectional area of the injection orifice and which is adapted to increase gradually in response to the lift of the nozzle needle.

By the provision of such an annular fuel passage, the rate of fuel injection at the earlier stage thereof can be restricted to be smaller and can be controlled in a manner as to increase gradually, which is quite effective in solving the problem noted above for the reason as will be described hereinlater.

BRIEF DESCRIPTION OF THE DRAWINGS

The features and advantages of the fuel injection nozzle according to the present invention will become more clearly appreciated from the following description taken in conjunction with the accompanying drawings, in which.

DESCRIPTION OF THE PREFERRED EMBODIMENTS

Figure 1:
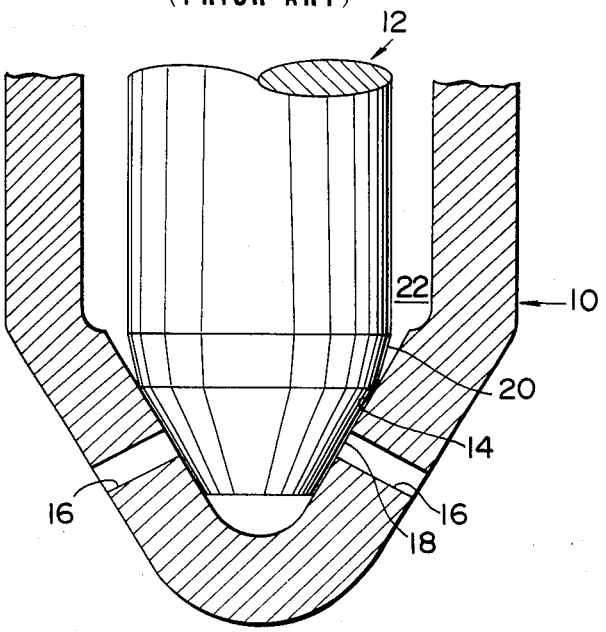
FIG.1 (PRIOR ART)
FIG. 1 is a longitudinal sectional view of a tip portion of a prior art hole type fuel injection nozzle.
Figure 2:
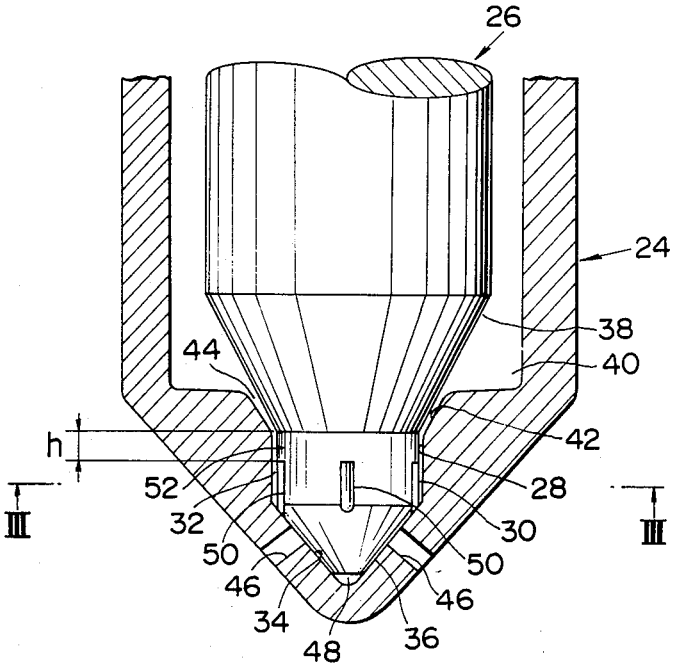
FIG. 2 is a view similar to FIG. 1 but shows a hole type fuel injection nozzle in accordance with a first embodiment of the present invention.
Figure 3:
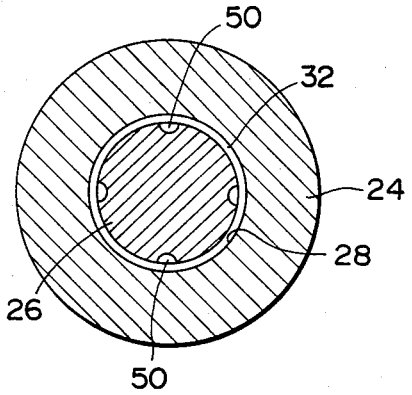
FIG. 3 is a sectional view taken along the line III—III of FIG. 2.

Before describing the preferred embodiments of this invention, reference is first made to FIG. 1 wherein a prior art hole type fuel injection nozzle as disclosed in the foregoing Japanese Utility Model Publication is shown, for the purpose of analyzing the foregoing problem of the prior art device.

In FIG. 1, the prior art hole type fuel injection nozzle is shown as comprising a nozzle body 10 and a nozzle needle 12. The nozzle body 10 has a hollow conical tip portion where it is formed with a conical valve seat 14. The tip portion of the nozzle body 10 is also formed with a plurality of injection orifices 16 of which upstream ends are located in the valve seat 14. The nozzle needle 12 is axially slidably received in the nozzle body 10 and its tip portion is formed with a conical valve portion 18 which closes the injection orifices 16 when seating on the valve seat 14. The tip portion of the nozzle needle 12 is also formed with a frustoconical portion 20 which defines part of a pressure chamber 22.

In operation, the nozzle needle 12 is lifted upwardly in the drawing by a predetermined pressure acting on the conical surface 20. The lift of the nozzle needle 12 results in a formation of an annular fuel passage between the valve seat 14 and the valve portion 18, through which annular fuel passage fuel flows into the injection orifices 16 and therefrom is discharged into the combustion chamber.

In the above described fuel injection nozzle, upon lifting of the nozzle needle 12 the sectional area of the fuel passage formed between the valve seat 14 and the valve portion 18 increases rapidly up to the area equal to the whole sum of the sectional areas of the injection orifices 16, thus allowing the rate of fuel injection to increase rapidly to the maximum possible rate that is determined by the whole sum of the sectional areas of the injection orifices 16. With this prior art fuel injection nozzle, a great amount of fuel is therefore injected into the combustion chamber at the earlier stage of fuel injection. This leads to a rapid rise of the pressure and temperature in the combustion chamber and therefore to a large combustion noise and a large nitrogen oxides (NOx) content in the exhaust gases. By the study conducted by the applicants, it is revealed that the foregoing problem of the prior art device is resulted from the rapid rise of fuel injection rate at the earlier stage thereof.

In view of this fact, it is proposed by the present invention a novel and improved fuel injection nozzle which is free from the foregoing problem and which will be described hereinafter.

Referring now to FIGS. 2 to 5, the fuel injection nozzle in accordance with a first embodiment of the present invention is shown as comprising a hollow nozzle body 24 and a nozzle needle 26 axially slidably received therein, though only the tip portion of the fuel injection nozzle is shown in the drawings. The nozzle body 24 has a conical tip portion where it is formed with a straight bore 28 which cooperates with a generally cylindrical surface 30 of the nozzle needle 26 to define therebetween an annular fuel passage 32. The downstream end of the bore 28 terminates in a conical valve seat 34 which may be engaged by a correspondingly cone-shaped seating surface 36 on the end of the nozzle needle 26 on the downstream end of the cylindrical surface 30 to define the initial section through which, when the nozzle needle is lifted, fluid may pass. The upstream end of the cylindrical surface 30 terminates in a pressure taper 38 which is surrounded by a pressure chamber 40 communicating with any suitable source of fluid under pressure, such as a fuel injection pump, not shown. The upstream end of the bore 28 terminates in a frustoconical flared portion 42 which may receive therein the downstream end portion of the pressure taper 38 in a manner to define therebetween a fuel passage 44 providing communication between the pressure chamber 40 and the annular fuel passage 32. The tip portion of the nozzle body 24 is also formed with a plurality of injection orifices 46 of which upstream ends are located in the valve seat 34 so that fuel flow through the injection orifices 46 are controlled by the seating surface 36 of the nozzle needle 26.

The conical seating surface 36 of the nozzle needle 26 has a blunted extremety so that a small fluid chamber 48 is defined between the extremeties of the seating surface 36 and the valve seat 34 when the seating surface seats on the valve seat.

The nozzle needle 26 is also formed at the downstream side portion of the cylindrical surface 30 with a plurality of grooves 50 extending axially of the nozzle needle to have a downstream end opening through the seating surface 36. The sectional area of the annular fuel passage section 32 defined between the upstream side portion of the cylindrical surface 30 and the bore 28 is smaller than the whole sum of the sectional areas of the injection orifices 46 so that the upstream side portion of the cylindrical surface 30 serves as a fuel flow restricting portion 52 of which downstream end is determined by the upstream end of the groove 50. The whole sum of the sectional areas of the above-mentioned annular fuel passage section 32 and the grooves 50 is designed to be larger than the whole sum of the sectional areas of the injection orifices 46. The axial length h of the fuel flow restricting portion 52 is designed to be smaller than the maximum lift of the nozzle needle 26 by such an amount that is determined depending upon how long at the earlier stage it is desired to restrict the rate of fuel injection. That is, the longer the fuel flow restricting portion is made, the longer at the earlier stage the rate of fuel injection is restricted.

Figure 4:
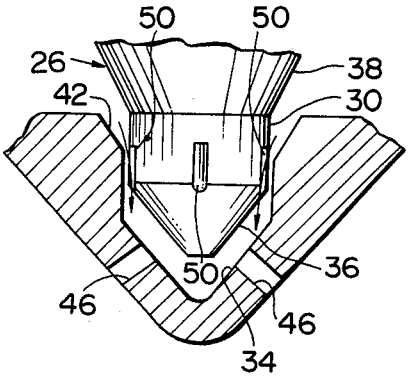
FIG. 4 is a view similar to FIG. 2 but shows the nozzle needle lifted to permit free fuel flow.

In operation, when the fuel pressure in the pressure chamber 40 increases up to a predetermined value, the pressure acting on the pressure taper 38 causes the nozzle needle 26 to be lifted, allowing the injection orifices 46 to open to initiate fuel injection. In this instance, at the first step of nozzle needle lift, that is, during the time when lift of the nozzle needle 26 is smaller than the length h of the fuel flow restricting portion 52, the rate of fuel injection is restricted by the fuel flow restricting portion 52 and is maintained small. When the lift of the nozzle needle 26 exceeds the length h of the fuel flow restricting portion 52 as shown in FIG. 4, fuel flows freely from the pressure chamber 40 to the injection orifices 46 through the grooves 50 in addition to the annular fuel passage 32. The sum of the sectional area of the annular fuel passage 32 and the additional area of fluid flow provided at a given instant by the grooves 50 comprises an elongated section. When the sectional area of the elongated section increases to such an extent that it exceeds the combined sectional area of the injection orifices 46, the rate of fuel injection is determined by the whole sum of the sectional areas of the injection orifices 46.

Figure 5:
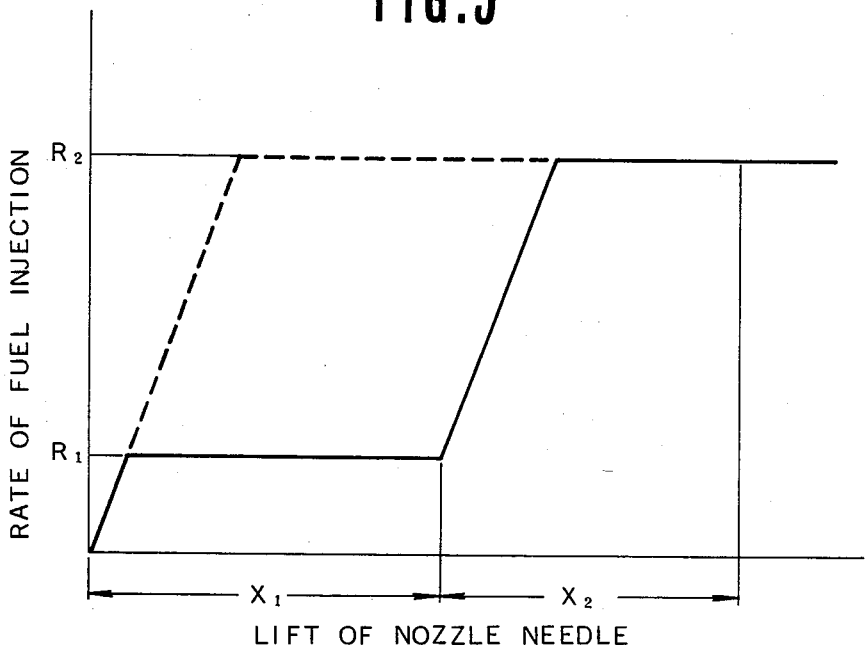
FIG. 5 is a graph illustrating the rate of fuel injection as a function of the nozzle needle lift, for the fuel injection nozzle of FIG. 2, the dotted line indicating the corresponding rate of fuel injection of the comparable prior art device.

Accordingly, the rate of fuel injection as a function of the lift of nozzle needle for the fuel injection nozzle in accordance with the first embodiment of this invention is controlled in such a manner as represented by the solid line in FIG. 5. That is, the fuel injection rate at the earlier stage of fuel injection (which corresponds to the nozzle needle lifting range $X_1$ and wherein the lift of nozzle needle is smaller than the length h of the fuel flow restricting portion 52) is restricted by the fuel flow restricting portion and set smaller as indicated by $R_1$, while at the later stage (which corresponds to the nozzle needle lifting range $X_2$ and wherein the lift of the nozzle needle exceeds the length H of the fuel flow restricting portion) the fuel injection rate is determined by the whole sum of the sectional areas of the injection orifices 46 and set larger as represented by $R_2$. The rate of fuel injection effected by the fuel injection nozzle of the first embodiment of this invention thus increases stepwisely and gradually.

Figure 6:
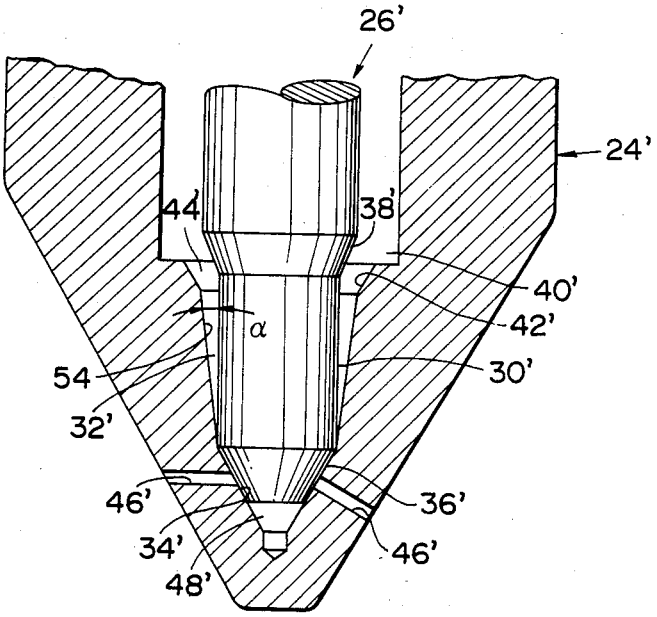
FIG. 6 is a view similar to FIG. 2 but shows a second embodiment of the present invention.
Figure 7:
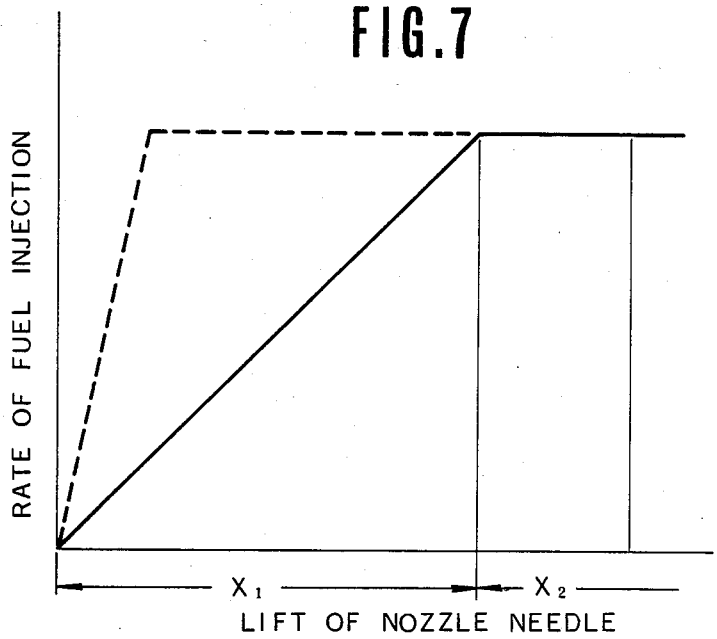
FIG. 7 is a graph similar to FIG. 5 but shows a performance characteristics of the second embodiment, the dotted line indicating the performance characteristics of the comparable prior art device.
Figure 8:
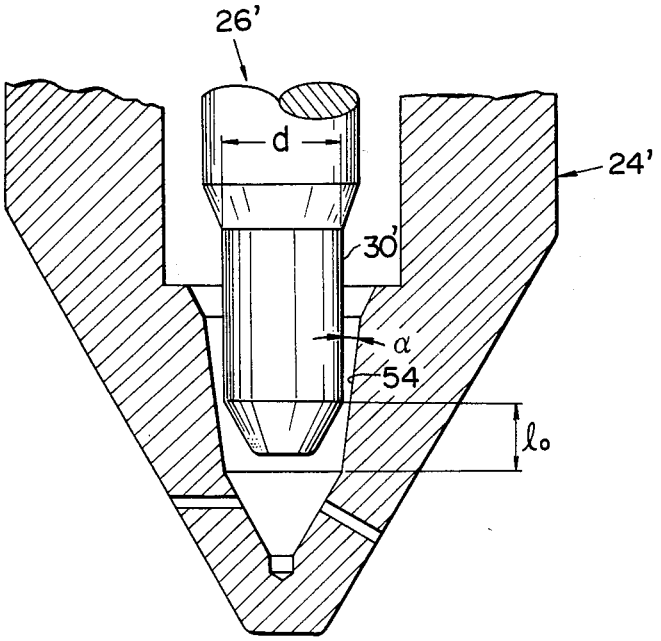
FIG. 8 is a view similar to FIG. 6 but shows the nozzle needle lifted nearly maximumly.

Referring to FIGS. 6 and 7, a modification in accordance with the present invention will be described hereinafter. In the modified embodiment, elements or parts substantially similar to or functionally identical with those of the previous embodiment are indicated by like reference numerals as their corresponding parts of the previous embodiment, with prime marks added and will not be described again for brevity.

In this modified embodiment, the nozzle body 24' is provided with a tapered bore 54 in place of the straight bore 28 in the previous embodiment, and the cylindrical surface 30' of the nozzle needle 26' is not provided with such grooves 50 as in the previous embodiment. With this modification, such an annular fuel passage 32' that has a pair of symmetrical triangular sections about the central axis thereof is defined between the tapered bore 54 and the cylindrical surface 30' when the seating surface 36' of the nozzle needle 26' is held seated on the valve seat 34'. In other words, the sectional area of the annular fuel passage 32' is largest at the upstream end and reduces gradually toward the downstream end where it is smallest. For this reason, the downstream end or smaller diameter end of the tapered bore 54 is designed to be nearly equal in the diameter to the cylindrical surface 30' of the nozzle needle 26'. more specifically, the fuel passage 32' is designed so that the sectional area of the fuel passage section defined between the downstream end of the cylindrical surface 30' and the tapered bore 54 when the nozzle needle 26' is lifted nearly maximumly, is equal to or larger than the whole sum of the sectional areas of the injection orifices 46. The taper of the tapered bore 54 is determined depending upon how much at the earlier stage of fuel injection it is desired to restrict the rate of fuel injection.

Figure 9:
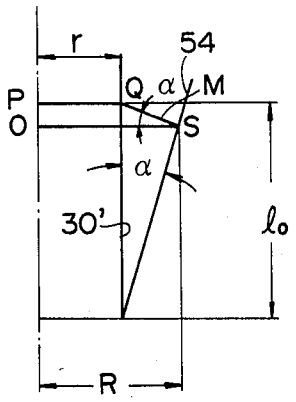
FIG. 9 is a diagrammatic view showing by an enlarged scale the details of the sectional area of the minimum fuel passage section defined between the nozzle needle and the nozzle body of FIG. 7.

Description being further made as to the fuel passage 32', the sectional area of the minimum fuel passage section defined between the downstream end of the cylindrical surface 30' and the tapered bore 54 when the nozzle needle 26' is lifted nearly maximumly is equal to the area M of the tapered peripheral surface of a truncated cone that is obtained, as diagrammatically shown in FIG. 9, by rotating a trapezoid OPQS about the axis OP (the central axis of the cylindrical surface 30'. The tapered peripheral surface area M is obtained from the following equation:

$$M = \pi(R + r)\sqrt{(R - r)^2 + h^2} \quad (1)$$

where R is the radius of the larger diameter end of the truncated cone, r is the radius of the smaller diameter end of the truncated cone and h is the height of the truncated cone.

In this instance, assuming that the lift of the nozzle needle 26' is l, the diameter of the cylindrical surface 30' of the nozzle needle 26' is d, and the angle which the tapered bore 54 and the cylindrical surface 30' form with each other with respect to a sectional plane passing through the central axis OP is $\alpha$, the following equations are obtained:

$$r = \frac{d}{2},\ h = l\sin^2\alpha,$$

$$R = \frac{1}{2}d + l\sin\alpha \cdot \cos\alpha$$

substitution of the equation (1) for $r = \frac{d}{2}$, $h = l\sin^2\alpha$, and $R = \frac{1}{2}d + l\sin\alpha \cdot \cos\alpha$ provides $$M = \pi l(d + l\sin\alpha \cdot \cos\alpha)\sin\alpha \quad (2)$$

By the experiments conducted by the applicants, it is found that the following formula must be satisfied in order to attain the desired restriction of the rate of fuel injection at the earlier stage thereof:

$$S_o \leqq M_o < 2S_o \quad (3)$$

where $S_o$ is the whole sum of the sectional areas of the injection orifices, that is, $S_o = n \cdot \pi/4d^2$ where n is the number of the injection orifices, and $M_o$ is the sectional area of the minimum fuel passage section when the nozzle needle is lifted by a predetermined full lift or maximum lift $l_o$.

From (2) and (3), the following equation is obtained:

$$\frac{nd^2}{4l_o} \leqq (d + l_o\sin\alpha \cdot \cos\alpha)\sin\alpha < \frac{nd^2}{2l_o} \quad (4)$$

Thus, the angle $\alpha$ is designed so as to satisfy the equation (4).

In operation of the modified embodiment, since at the earlier stage of nozzle needle lift the sectional area of the minimum fuel passage section defined between the downstream end of the cylindrical surface 30' and the tapered bore 54 is maintained smaller than the whole sum of the sectional areas of the injection orifices 46' and adapted to increase gradually as the lift of the nozzle needle increases, the rate of fuel injection increases gradually as represented by the solid line in FIG. 7. The dotted line in FIG. 7 indicates the performance characteristics of the comparable prior art device.

Obviously, numerous modifications and variations of the present invention are possible in light of the above teachings. It is therefore to be understood that within the scope of the appended claims, the invention may be practiced otherwise than as specifically described.

What is claimed is:

1. A fuel injection nozzle comprising:

a hollow nozzle body formed at the tip portion thereof with a conical valve seat and at least one fuel injection orifice having an upstream end located in said valve seat;

a nozzle needle axially movable in said nozzle body and formed at an end with a conical seating surface engageable with said valve seat to provide an initial section between said valve seat and said seating surface for controlling fuel flow through said injection orifice in response to the lift of said nozzle needle; and means for defining an annular fuel passage between said nozzle body and said nozzle needle at a location upstream of said initial section, said means including an elongated section separate from said initial section, said elongated section having a fuel passage section of which the sectional area is, at the earlier stage of fuel injection, maintained smaller than the sectional area of said injection orifice and which is adapted to prolong the gradual increase in flow to said fuel injection orifice in response to the lift of said nozzle needle.

2. A fuel injection nozzle as set forth in claim 1 in which said nozzle body is formed with a straight bore of which downstream end terminates in said valve seat, said nozzle needle being formed with a generally cylindrical surface which cooperates with said straight bore to define therebetween part of said elongated section, said cylindrical surface having a downstream end terminating in said conical seating surface, and in which said nozzle needle is also formed at the downstream side portion of said cylindrical surface with at least one groove extending axially of the nozzle needle to have a downstream end opening through said seating surface, said groove forming part of said elongated section and cooperating with said cylindrical surface and said straight bore to constitute said annular fuel passage means.

3. A fuel injection nozzle as set forth in claim 2 in which said groove is of a length shorter than a predetermined maximum lift of said nozzle needle.

4. A fuel injection nozzle as set forth in claim 3 in which said cylindrical surface of said nozzle needle has an upstream side portion of which down stream end is defined by the upstream end of said groove, and in which the sectional area of the annular fuel passage section defined between said upstream side portion of said cylindrical surface and said straight bore is smaller than the sectional area of said injection orifice, the whole sum of the sectional areas of said annular fuel passage section defined between the upstream side portion of the cylindrical surface and the straight bore and said groove being larger than the sectional area of said injection orifice.

5. A fuel injection nozzle as set forth in claim 4 in which said nozzle needle further has a pressure taper in which the upstream end of said cylindrical surface terminates and which is surrounded by a pressure chamber, and in which said nozzle body further has a frustoconical flared portion in which the upstream end of said cylindrical surface terminates and which may receive therein the downstream end portion of said pressure taper in a manner to define therebetween a fuel passage providing communication between said pressure chamber and said annular fuel passage.

6. A fuel injection nozzle as set forth in claim 1 in which said nozzle body is formed with a tapered bore of which downstream end terminates in said valve seat, and in which said nozzle needle is formed with a generally cylindrical surface which cooperates with said tapered bore to define therebetween said annular fuel passage of which sectional area is largest at the upstream end and reduces gradually toward the downstream end where it is smallest, said tapered bore and said cylindrical surface constituting said annular fuel passage defining means.

7. A fuel injection nozzle as set forth in claim 6 in which the downstream end of said tapered bore is nearly equal in diameter to said cylindrical surface.

8. A fuel injection nozzle as set forth in claim 7 in which said annular fuel passage is adapted to have such a fuel passage section when said nozzle needle is lifted nearly maximumly that is equal to or larger than the sectional area of said injection orifice.

9. A fuel injection nozzle as set forth in claim 8 in which said nozzle needle further has a pressure taper in which the upstream end of said cylindrical surface terminates and which is surrounded by a pressure chamber, and in which said nozzle body further has a frusto-conical flared portion in which the upstream end of said straight bore terminates and which may receive therein the downstream end portion of said pressure taper in a manner to define therebetween a fuel passage for providing communication between said pressure chamber and said annular fuel passage.

10. A fuel injection nozzle comprising:

a hollow nozzle body formed at the tip portion thereof with a conical valve seat and a plurality of injection orifices having an upstream end located in said valve seat;

a nozzle needle axially movable in said nozzle body and formed at an end with a conical seating surface engageable with said valve seat to provide an initial section between said valve seat and said seating surface for controlling fuel flow through said orifices in response to the lift of said nozzle needle; and means for defining an annular fuel passage between said nozzle body and said nozzle needle at a location upstream of said initial section, said means including an elongated section separate from said initial section, said elongated section having a fuel passage section of which the sectional area is, at the earlier of fuel injection, maintained smaller than the whole sum of the sectional areas of said injection orifices and which is adapted to prolong the gradual increase in flow to said fuel injection orifice in response to the lift of said nozzle needle.

* * * * *